US011371321B2

(12) United States Patent
Iguaz et al.

(10) Patent No.: US 11,371,321 B2
(45) Date of Patent: Jun. 28, 2022

(54) SYSTEM AND METHOD FOR DRILLING LATERAL BOREHOLES USING ARTICULATED DRILL STRING COMPONENTS

(71) Applicants: Jose Iguaz, Thousand Oaks, CA (US); Ronald Phillips, Buena Park, CA (US)

(72) Inventors: Jose Iguaz, Thousand Oaks, CA (US); Ronald Phillips, Buena Park, CA (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/362,315

(22) Filed: Mar. 22, 2019

(65) Prior Publication Data

US 2020/0300061 A1 Sep. 24, 2020

(51) Int. Cl.

| | |
|---|---|
| ***E21B 7/06*** | (2006.01) |
| ***E21B 17/20*** | (2006.01) |
| ***E21B 23/12*** | (2006.01) |
| ***E21B 41/00*** | (2006.01) |
| *E21B 3/04* | (2006.01) |

(52) U.S. Cl.

CPC ..... *E21B 41/0035* (2013.01); *E21B 7/061* (2013.01); *E21B 17/20* (2013.01); *E21B 23/12* (2020.05); *E21B 3/04* (2013.01)

(58) Field of Classification Search

CPC ..... E21B 17/06; E21B 23/12; E21B 47/003

See application file for complete search history.

(56) References Cited

U.S. PATENT DOCUMENTS

| | | | | |
|---|---|---|---|---|
| 2,669,430 | A * | 2/1954 | Zublin | E21B 7/061 175/74 |
| 4,397,360 | A * | 8/1983 | Schmidt | E21B 7/061 175/61 |
| 9,493,988 | B2 | 11/2016 | Phillips | |
| 2015/0008045 | A1* | 1/2015 | Downton | E21B 17/1014 175/73 |
| 2015/0136490 | A1* | 5/2015 | Broussard, Jr. | E21B 10/02 175/57 |
| 2016/0326804 | A1* | 11/2016 | Gao | E21B 17/1014 |

* cited by examiner

*Primary Examiner* — Robert E Fuller
*Assistant Examiner* — Lamia Quaim
(74) *Attorney, Agent, or Firm* — Cantor Colburn LLP

(57) ABSTRACT

An apparatus for drilling a secondary borehole includes a whipstock assembly configured to be deployed in a primary borehole, the whipstock assembly including a whipstock ramp, and a drilling assembly connected to a borehole string. The drilling assembly includes a drill bit connected to an articulated string portion having a plurality of connected sections configured to move laterally with respect to one another, and the articulated string portion is configured to be diverted by the whipstock ramp in a lateral direction to initiate drilling of a secondary borehole from the primary borehole.

18 Claims, 5 Drawing Sheets

SYSTEM AND METHOD FOR DRILLING LATERAL BOREHOLES USING ARTICULATED DRILL STRING COMPONENTS

BACKGROUND

In the resource recovery industry, the drilling of lateral boreholes from a primary borehole is increasingly utilized to increase production from resource bearing formations. Some systems for drilling lateral boreholes utilize whipstocks, which divert the direction of a drill string in a direction lateral to the primary borehole. Typically the angle and length of the whipstock dictates the borehole length needed to drill an initial portion of a lateral well (rathole) and establish an exit from the primary borehole.

SUMMARY

An embodiment of an apparatus for drilling a secondary borehole includes a whipstock assembly configured to be deployed in a primary borehole, the whipstock assembly including a whipstock ramp, and a drilling assembly connected to a borehole string, the drilling assembly including a drill bit connected to an articulated string portion having a plurality of connected sections configured to move laterally with respect to one another. The articulated string portion is configured to be diverted by the whipstock ramp in a lateral direction to initiate drilling of a secondary borehole from the primary borehole.

An embodiment of a method of drilling a secondary borehole includes deploying a whipstock assembly in a primary borehole, the whipstock assembly including a whipstock ramp, and deploying a borehole string including a drilling assembly in the primary borehole, the drilling assembly including a drill bit connected to an articulated string portion. The articulated string portion has a plurality of connected sections configured to move laterally with respect to one another. The method also includes rotating the drill bit and advancing the drilling assembly along the whipstock assembly, and diverting the drill bit and the articulated string portion in a lateral direction by the whipstock ramp to initiate drilling of a secondary borehole from the primary borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed systems and methods are presented herein by way of exemplification and not limitation with reference to the Figures.

Methods, systems and apparatuses are provided herein for drilling or otherwise forming a secondary (lateral) borehole that extends from a primary borehole. An embodiment of a drilling system includes a drill string having an articulated string portion that permits the drill string to be directed in a lateral direction to initiate a secondary borehole and/or drill a length of the secondary borehole. In one embodiment, the drilling system includes a whipstock assembly for directing the drilling assembly and the articulated string portion in a lateral direction to initiate the secondary borehole.

Embodiments described herein provide a number of advantages. For example, typical whipstock sidetracking operations require a relatively long length of the primary borehole to initiate and drill a secondary borehole. The articulated string portion and whipstock described herein allow for the drill string to initiate the secondary borehole (e.g., turn from a vertical or near vertical to a horizontal direction) using a smaller length of the primary borehole. This allows for more secondary boreholes to be drilled from a primary borehole and provides for quicker exit.

The ability to more quickly drill a secondary borehole and drill the secondary borehole using a smaller length of the primary borehole is useful for a variety of applications, including drilling in a geothermal environment. For example, multiple laterals can be drilled within a fracture zone in a single trip, as the drilling assembly can be retracted from a secondary borehole and used to drill additional secondary boreholes without having to remove the drilling assembly to the surface.

Figure 1:
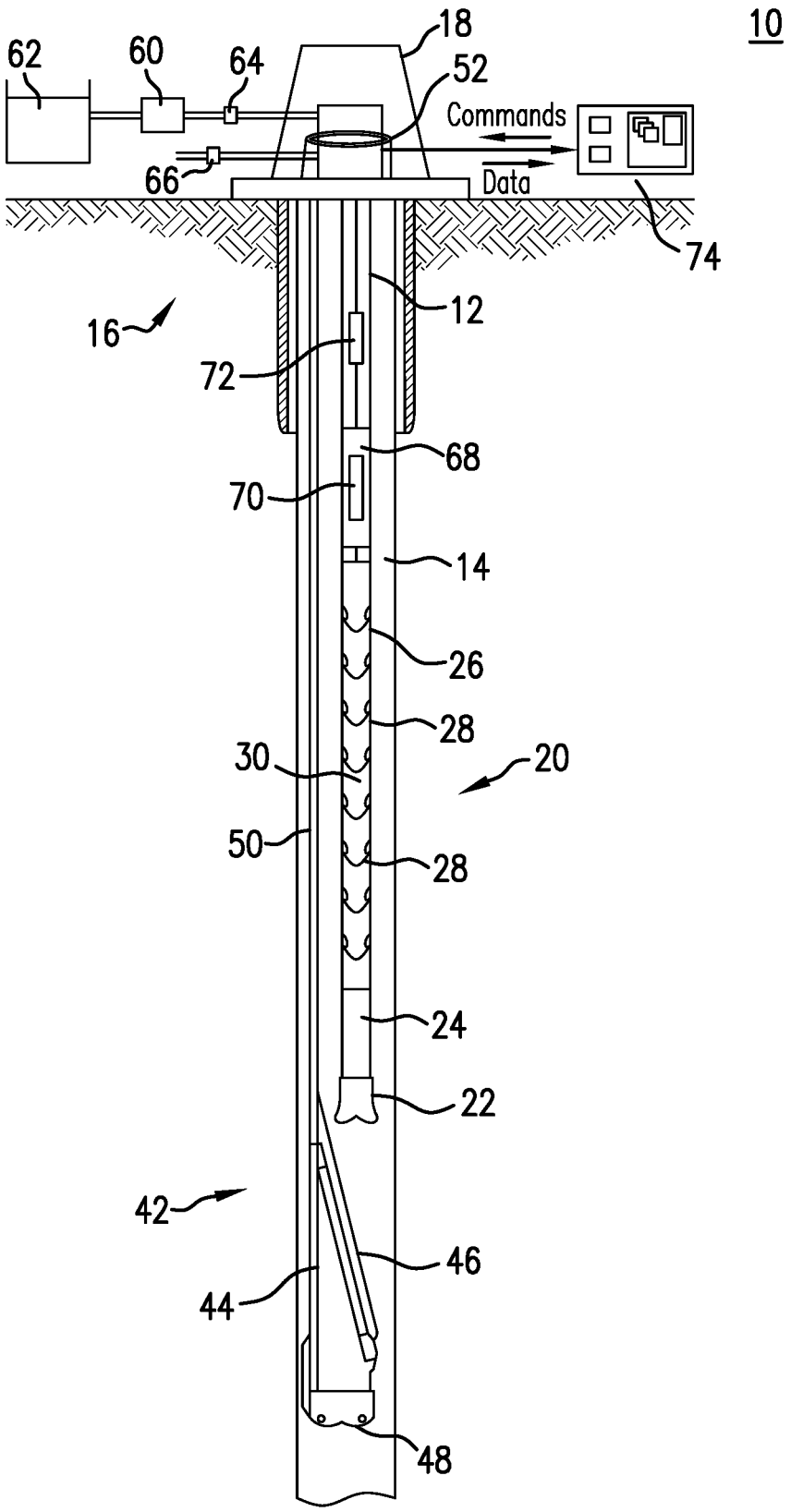
FIG. 1 depicts an embodiment of a drilling system for forming a secondary borehole from a primary borehole, which includes a drilling assembly having an articulated string portion and a whipstock assembly.

Referring to FIG. 1, an embodiment of a well drilling (and/or milling) system 10 includes a borehole string 12 that is shown disposed in a well or borehole 14 that penetrates at least one resource bearing (or potentially resource bearing) formation 16 during a drilling, milling or other downhole operation. As described herein, "borehole" or "wellbore" refers to a hole that makes up all or part of a drilled well. It is noted that the borehole 14 may include vertical, deviated and/or horizontal sections, and may follow any suitable or desired path. As described herein, "formations" refer to the various features and materials that may be encountered in a subsurface environment and surround the borehole 14.

A surface structure or surface equipment includes or is connected to various components such as drill rig 18. The drill rig 18 may include a wellhead, derrick and/or rotary table for performing various functions, such as supporting the borehole string 12, deploying the borehole string 12 into the borehole 14, rotating the borehole string 12, circulating fluid, communicating with downhole components, performing surface measurements and/or performing downhole measurements. In one embodiment, the borehole string 12 is a drill string including one or more pipe sections that extend into the borehole 14. The borehole string 12 is not so limited and may be constituted of different components, such as coiled tubing.

In one embodiment, the system 10 includes a drilling apparatus or assembly 20 configured to be controlled to form an initial length (sometimes referred to as a "rathole") of a secondary borehole extending from the borehole 12. One or more components of the drilling assembly 20 can be configured as a bottomhole assembly (BHA). The drilling assembly 12 may also be used to drill subsequent lengths of the secondary borehole. Operations that include forming ratholes and/or secondary boreholes are referred to herein as sidetracking operations. The borehole 12 in such an embodiment is referred to herein as a primary borehole or pilot borehole.

The drilling assembly 20 includes a drill bit 22 connected to the borehole string 12. In one embodiment, the drilling assembly includes a downhole drilling motor 24 such as a mud motor 24. The drilling assembly 20 may include other components, such as drill collars, stabilizers, steering components and/or sensors for measuring downhole conditions (e.g., pressure, temperature, flow rate and others).

The system 10 is not limited to use with a drilling assembly and/or drill bit. For example, the system 10 may instead use a milling assembly having, e.g., a lead mill and one or more following mills such as watermelon mills. Milling assemblies can be used, for example, to initiate a secondary borehole through casing.

The drilling assembly 20 and/or the borehole string 12 also includes an articulated string portion 26 having one or more joints 28 that connect string sections 30. The articulated string portion 26 allows the drilling assembly 20 to be directed away from the borehole 12 along a relatively short length of the borehole 14 (e.g., less than about 100 feet). This is advantageous in high temperature and pressure environments such as geothermal environments.

In the embodiment of FIG. 1, the drill bit 22 is driven by the downhole mud motor 24, which facilitates the transition to a lateral direction. For example, the mud motor 24 allows for rotating the drill bit 22 without having to torque through the borehole string 12 and the articulated string portion 26. As discussed further below, in some embodiments, the drilling assembly 20 can be driven from the surface.

Figure 2:
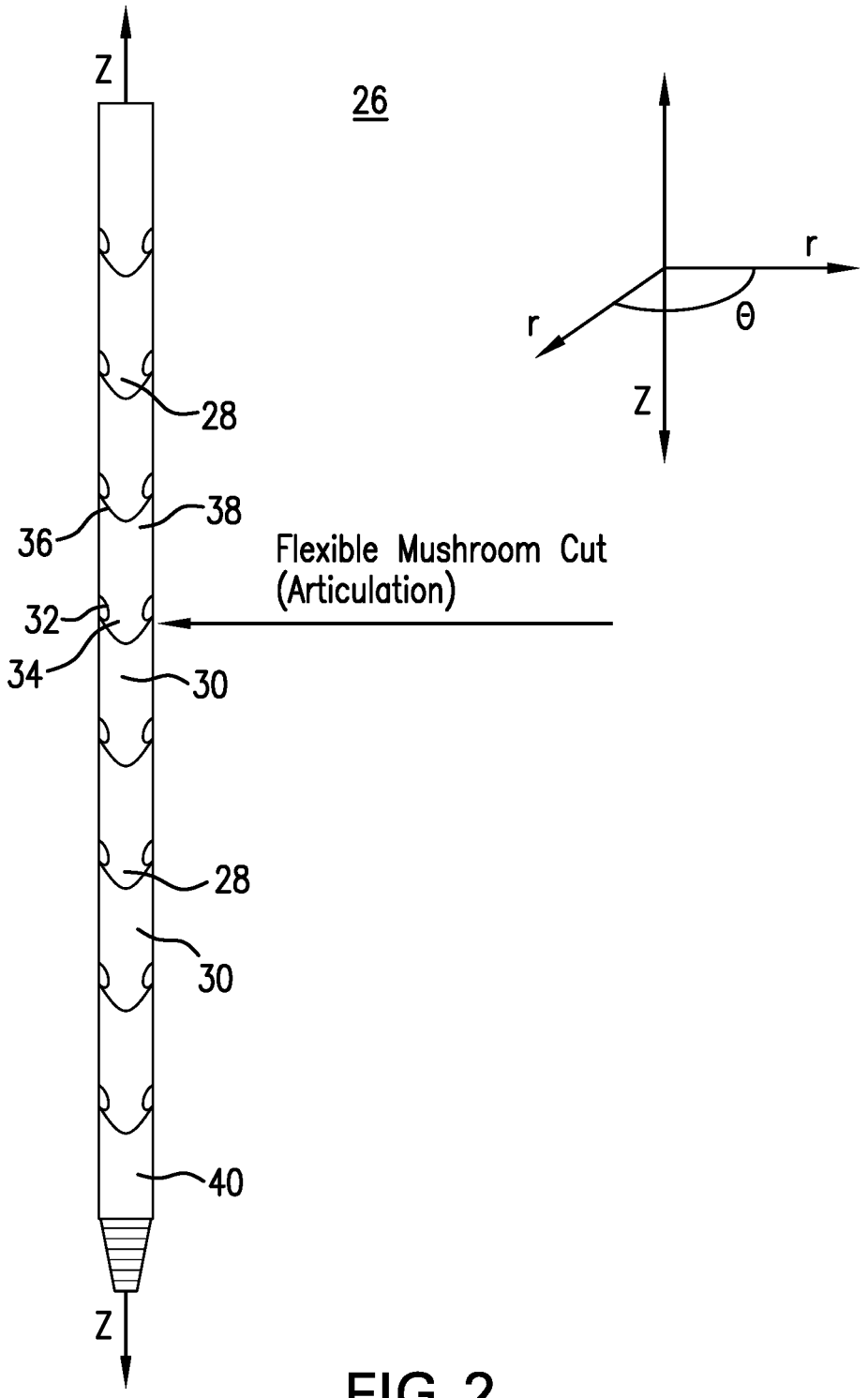
FIG. 2 illustrates an embodiment of the articulated string portion of FIG. 1.

An embodiment of the articulated string portion 26 is shown in FIG. 2. In this embodiment, the articulated string portion includes a plurality of interlocking string sections 30. Each string section 30 may include a first end 32 at which the wall of the string section 30 has been cut, molded or otherwise formed so that the wall forms one or more axially protruding male interlocking portions 34 (referred to herein as male portions 34). Each string section 30 may also include a second end 36 at which the wall of the string section 30 has been cut, molded or otherwise formed so that the wall forms one or more axially receding female interlocking portions 38 (referred to herein as female portions 38). Adjacent sections 30 are operably connected so that the female portion(s) 38 of one string section 30 fit into the male portion(s) of another string section 30 and allow some degree of radial and/or angular movement. Such movement allows the articulated string portion 26 to bend due to interaction with a whipstock, guide or other steering component.

Relative sizes and shapes of the male portions 34 and the female portions 38 are selected so that there is a gap therebetween. The gap between the male portion 34 and the female portion 38 of adjacent string sections 30 permits a first string section 30 to move laterally relative to an adjacent second string section 30. Lateral movement may include radial movement and/or angular movement in a direction orthogonal to a longitudinal axis of the borehole 14, the borehole string 12 and/or the second string section. For example, movement directions are shown in FIG. 2, in which the longitudinal axis is z, the radial direction is r and the angular direction is θ.

The male portions 34 and the female portions 38 may have any suitable shape, and each end may have any suitable number of male portions and/or female portions. For example, in the string section 30 of FIG. 2, the ends are cut in a "mushroom" cut configuration, in which the male portion 34 has a wide top and relatively narrow supporting portion. Other shapes include, e.g., circular or ovular shapes, dovetail shapes interlocking teeth and others.

Each string section 30 includes features configured to prevent flow of fluid from the central fluid conduit through gaps between interlocking ends. For example, a deformable compression seal can be fit into the gaps to allow relative movement of adjacent string sections 30 while preventing fluid flow into the borehole annulus. Other examples include o-rings and/or an inner liner or sleeve, such as a rubber inner liner.

The joints 28 are not limited to the configuration and type discussed above, as the joints may be any type of joint that permits relative lateral movement between string sections 30. For example, the joints 28 may be ball joints or universal joints of any kind. Another example of a joint 28 is a constant-velocity (CV) joint.

In one embodiment, the articulated string portion 30 is configured as a drill collar, and each section 30 is a length of a drill collar. Drill collars typically have thicker walls than other parts of the drill string (e.g., pipe sections) and are provided to add weight to the drilling assembly 20.

The articulated string portion 26 may be connected to components of the drilling assembly 20 in any suitable manner. For example, as shown in FIG. 2, the lower end of the articulated string portion 26 includes a threaded connector 40 such as a pin connector configured to engage a box connector on the drill bit 22 or other component.

The system 10 of FIG. 1 is described as being configured to form secondary boreholes from an open hole section of the primary borehole 12, but is not so limited. For example, the system 10 can also form secondary boreholes from cased sections of the primary borehole 12. In this example, the system 10 may include a milling bit (such as a window mill) to mill a window or section of the casing.

The system 10, in one embodiment, includes a whipstock assembly 42 having a whipstock 44 that is deployed in the primary borehole 12 to a selected location corresponding to the location at which a secondary borehole is to be drilled. The whipstock 44 includes a whipstock ramp 46 that acts to guide the drilling assembly 12 when performing a sidetracking operation. The whipstock ramp 46 may have a straight slope as shown in FIG. 1, but may have other configurations, such as multiple straight slopes or a curved slope. A component such as a guide and/or anchor is connected to the whipstock to facilitate deployment. For example, the whipstock assembly 42 includes a guide component such as a bull nose 48.

Figure 3:
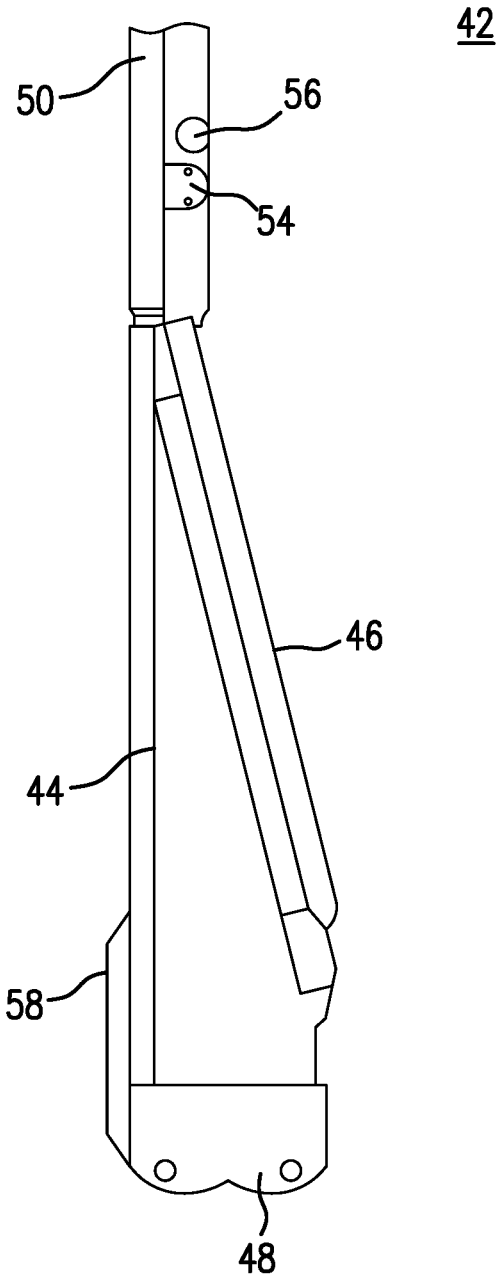
FIG. 3 depicts an embodiment of the whipstock assembly of FIG. 1.

Referring to FIG. 3, in one embodiment, the whipstock assembly is configured to be lowered into the borehole 12 by a support string 50 attached thereto. The support string 50 may be a hang down string that is supported by a hanger 52 at the drill rig 18. The support string 50 may include an orienting lug 54 that can interact with a gyroscopic tool in the drilling assembly to orient the whipstock 44 as desired. The support string 50 may also have one or more ports 56 disposed near the upper end of the whipstock 44 so that a reverse circulation path can be employed during drilling the secondary borehole to cool the drilling assembly 20. This can be particularly useful in high temperature environments such as deep geothermal regions. One or more pads 58 can be disposed opposite the whipstock ramp.

The whipstock assembly 42 is not limited to the assembly shown in FIGS. 1 and 3. For example, the whipstock assembly 42 may be a hydraulically actuated assembly having an anchor that can be set by applying fluid pressure. In another example, the whipstock 44 can be deployed with the drill string 12, e.g., by attaching the drill bit 20 to the whipstock 44 (e.g., via a shear pin or bolt) and releasing the drill bit 20 prior to commencing the sidetracking.

It is noted that terms such as "upper," "lower," "upward", "downward," "uphole" and "downhole" are used herein to describe relative positions of various components. Such terms are used to denote relative positions of components along a borehole with respect to a surface end of the borehole, which may or may not correspond to vertical depth locations, as the borehole 12 and/or secondary boreholes may not be vertical. For example, the borehole 12 and secondary boreholes can have deviated and/or horizontal sections. Thus, for example, an upper location refers to a location that is closer to the surface along the path of the borehole than a reference location; as the path may be deviated, horizontal or directed toward the surface, the upper location may be at the same or similar vertical depth, or even below the reference location.

Referring again to FIG. 1, the system 10 includes components to facilitate circulating fluid such as drilling mud through the borehole string 12. The components also allow for control of fluid flow rate and/or pressure through the support string 50 and/or to actuate a whipstock anchor if included. For example, a pumping device 60 is located at the surface to circulate fluid from a mud pit or other fluid source 62 into the borehole 14 and control fluid flow and/or pressure to realize various functions and methods described herein.

Surface and/or downhole sensors or measurement devices may be included in the system 10 for measuring and monitoring aspects of an operation, fluid properties, component characteristics and others. For example, the system 10 includes fluid pressure and/or flow rate sensors 64 and 66 for measuring fluid flow into and out of the borehole 12, respectively. Fluid flow characteristics may also be measured downhole, e.g., via fluid flow rate and/or pressure sensors in the borehole string 12.

The borehole string 12 may include additional tools and/or sensors for measuring various properties and conditions. For example, the borehole string 12 includes a LWD or MWD measurement tool 68 that has one or more sensors or sensing devices 70 for detecting and/or analyzing formation measurements, such as resistivity, seismic, acoustic, gamma ray, and/or nuclear measurements. The one or more sensing devices 70 can be configured to measure borehole conditions (e.g., temperature, flow rate, pressure, chemical composition and others) and/or tool conditions (vibration, wear, strain, stress, orientation, location and others).

In one embodiment, one or more downhole components and/or one or more surface components are in communication with and/or controlled by a processor such as a downhole processor 72 and/or a surface processing unit 74. In one embodiment, the surface processing unit 74 is configured as a surface control unit which controls various parameters such as rotary speed, weight-on-bit, fluid flow parameters (e.g., pressure and flow rate) and others.

Figure 4:
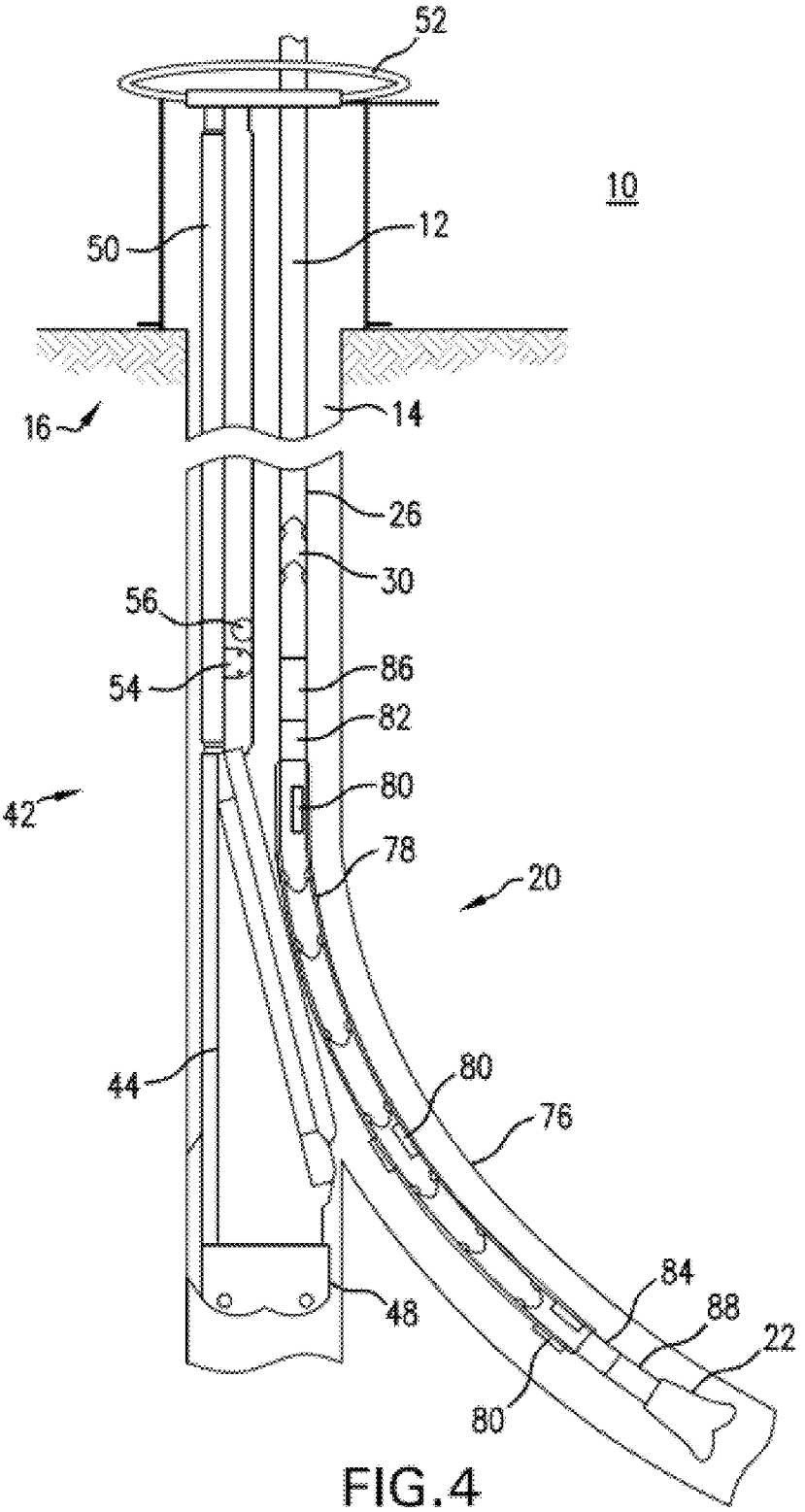
FIG. 4 depicts an embodiment of a drilling system for forming a secondary borehole from a primary borehole, which includes a drilling assembly having an articulated string portion, a curved drill string guide and a whipstock assembly.

FIG. 4 illustrates an embodiment of the drilling assembly 20 during drilling of a secondary borehole 76. In this embodiment, the drilling assembly 20 and the drill bit 22 are rotated from the surface, e.g., by a top drive.

In this embodiment, the drilling assembly 20 includes a non-rotating sleeve or housing 78 that surrounds all or part of the articulated string portion 26. In this context, "non-rotating" refers to not being rotated directly by the top drive or rotated with the drill string; the sleeve 78 in some instances may rotate at a lower rate than the drill string.

The sleeve 78, in one embodiment, is a curved sleeve that forms a flexible curved guide through which the articulated string section 26 extends to the drill bit 22. The curved sleeve 78 is flexible so that the sleeve 78 is forced into a straight path as the sleeve 78 is deployed through the primary borehole 12. To facilitate keeping the sleeve 78 straight during deployment, one or more laterally extendable members such as guide pads 80 may be incorporated into the sleeve. The guide pads can be operated using, e.g., the surface processing unit 74 via a communication cable or wired pipe.

The sleeve 78 may be mounted on the articulated string section 26 by an upper bearing assembly 82 and a lower bearing assembly 84. A clutch sub 86 or other suitable mechanism may be connected to the articulated string section 26 and actuated to engage the string section 26, e.g., to change an orientation of the sleeve 78. In one embodiment, a shock sub 88 is disposed between the articulated string section 26 and the drill bit 22 to reduce shock and vibration on the drill bit 22 and the drilling assembly as the secondary borehole 76 is initiated and/or drilled.

The drilling assembly as shown in FIG. 4 has advantages in high temperature and pressure environments, such as geothermal environments. In such environments, geothermal drilling through fractures can result in loss of circulation and expose the drilling assembly to temperatures that can exceed the temperature ratings of mud motors. The embodiment of FIG. 4 eliminates the need for a mud motor, while still managing drill string vibrations through the use of, e.g., the shock sub 88.

Figure 5:
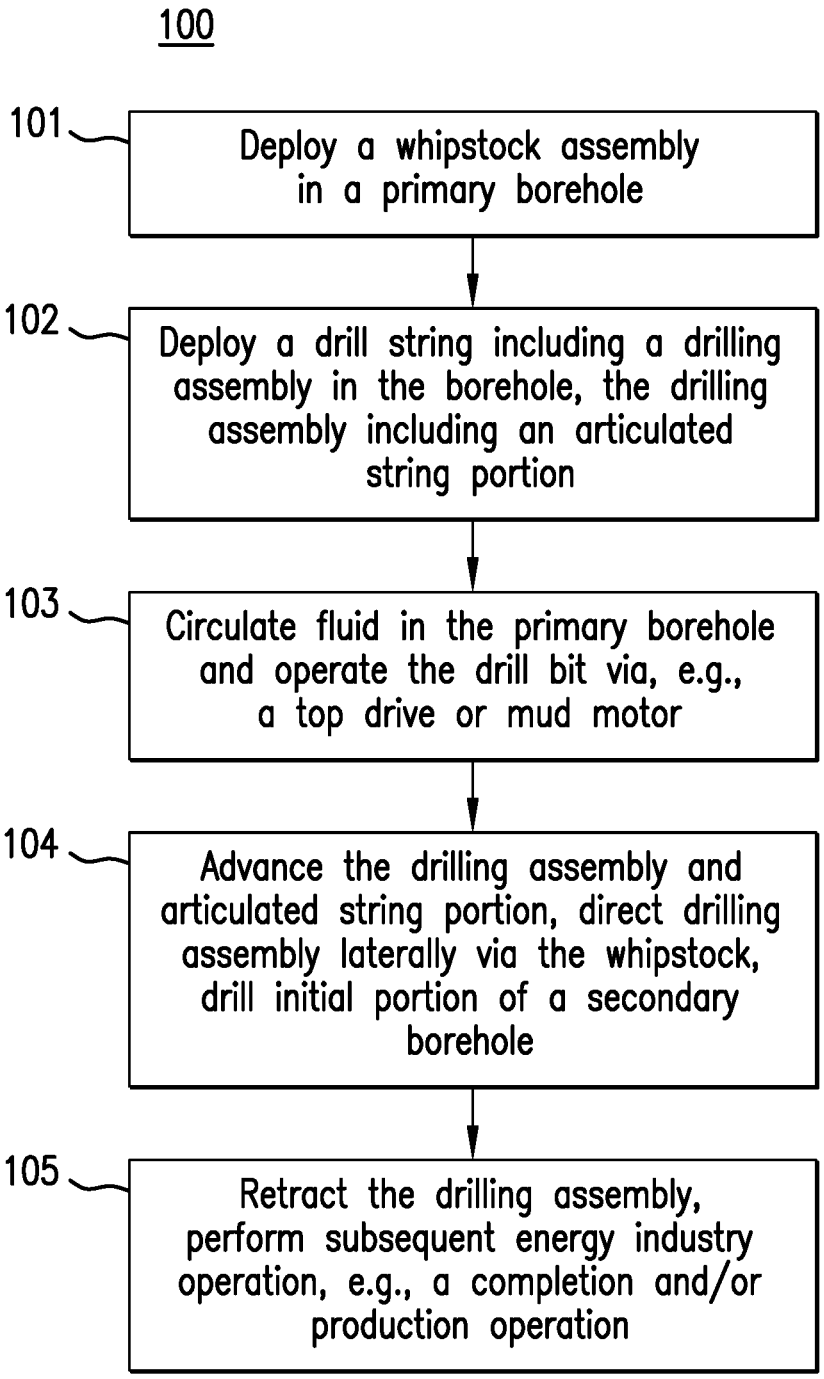
FIG. 5 is a flow chart depicting aspects of a drilling and/or sidetracking operation.

FIG. 5 illustrates a method 100 of performing aspects of a milling operation. The milling operation is described in conjunction with a sidetracking operation but is not so limited and can be used with any operation that employs a downhole mill. Aspects of the method 100 may be performed by a processor such as the surface processing unit 74 and/or the downhole processor 72, either automatically or through input by a human operator.

The method 100 includes one or more of stages 101-105 described herein. In one embodiment, the method 100 includes the execution of all of stages 101-105 in the order described. However, certain stages 101-105 may be omitted, stages may be added, or the order of the stages changed.

In the first stage 101, the whipstock assembly 42 is deployed into a primary borehole 12. The whipstock assembly is deployed by, e.g., the support string 50, until the whipstock assembly 42 reaches a selected location.

In the second stage 102, a borehole string 12 and a drilling assembly 20 is deployed into the primary borehole 12. The drilling assembly 20 includes an articulated drill string section 30 and a drill bit 22. The drilling assembly 20 is deployed until the drill bit 22 reaches the whipstock ramp 46.

In the third stage 103, fluid is circulated through the borehole string 12 and the drill bit is operated, e.g., by a mud motor 24 or by a top drive.

In the fourth stage 104, as the drill bit 22 is rotated, the drilling assembly 20 is advanced along the whipstock ramp 46 and an initial length of the secondary borehole 76 is initiated. The articulated string portion 26 may be directed primarily by the whipstock 44, or an additional steering mechanism may be included. For example, the drilling assembly 20 can include a curved sleeve 78 that acts in addition to the whipstock to direct the articulated string portion 26 to a deviated or horizontal direction.

Once the initial length of the secondary borehole 76 is formed, the drilling assembly 20 can continue to advance to drill a selected length of the secondary borehole 76.

In the fifth stage 105, the drilling assembly 20 is retracted from the secondary borehole 76 and a subsequent operation is performed. For example, the whipstock 44 and/or the drilling assembly 20 can be moved to a different location and/or re-oriented to drill another secondary borehole. Other subsequent operations include, e.g., stimulation, completion and production operations.

It is noted that the method 100 can include various other functions. For example, sensors such as the pressure and/or flow rate sensors 64 and 66 can be used to monitor pressure and/or flow rate during the above stages. In addition, various other measurements can be performed, e.g., via one or more LWD tools, to evaluate the formation and/or monitor conditions of fluid in the borehole and/or operation of downhole components.

Aspects of the method 100 can be repeated to drill multiple secondary or lateral boreholes. As the length required for drilling a secondary borehole is less than conventional sidetracking operations, the method 100 allows for drilling more secondary boreholes than conventional sidetracking systems, which can improve productivity by, e.g., exposing more fractures in the formation.

Set forth below are some embodiments of the foregoing disclosure:

Embodiment 1: An apparatus for drilling a secondary borehole, the apparatus comprising: a whipstock assembly configured to be deployed in a primary borehole, the whipstock assembly including a whipstock ramp; a drilling assembly connected to a borehole string, the drilling assembly including a drill bit connected to an articulated string portion having a plurality of connected sections configured to move laterally with respect to one another, wherein the articulated string portion is configured to be diverted by the whipstock ramp in a lateral direction to initiate drilling of a secondary borehole from the primary borehole.

Embodiment 2: The apparatus as in any prior embodiment, wherein the plurality of connected sections includes a first section and an adjacent second section connected by a joint configured to permit the first section to be oriented laterally relative to the second section.

Embodiment 3: The apparatus as in any prior embodiment, wherein the joint is formed by a wall of the first section having a shape configured as a male portion, and a wall of the second section having a shape configured as a female portion, the male portion configured to fit into the female portion to connect the first section to the second section.

Embodiment 4: The apparatus as in any prior embodiment, wherein the male portion and the female portion are configured to form a gap therebetween, the gap permitting the male portion to be oriented laterally relative to the female portion.

Embodiment 5: The apparatus as in any prior embodiment, further comprising a fluid displacement motor disposed between the articulated string portion and the drill bit.

Embodiment 6: The apparatus as in any prior embodiment, wherein the drilling assembly and the articulated string portion are configured to be rotated from a surface location.

Embodiment 7: The apparatus as in any prior embodiment, further comprising a shock absorbing assembly disposed between the articulated string portion and the drill bit.

Embodiment 8: The apparatus as in any prior embodiment, further comprising a curved sleeve surrounding at least part of the articulated string portion, the curved sleeve configured to direct the articulated string portion laterally as the articulated string portion is advanced along the whipstock assembly.

Embodiment 9: The apparatus as in any prior embodiment, wherein the non-rotating sleeve includes one or more extendable members configured to be actuated to engage a surface of the borehole to change a direction of the drilling assembly.

Embodiment 10: The apparatus as in any prior embodiment, further comprising a processing device configured to control an operational parameter of the drill string.

Embodiment 11: A method of drilling a secondary borehole, the method comprising: deploying a whipstock assembly in a primary borehole, the whipstock assembly including a whipstock ramp; deploying a borehole string including a drilling assembly in the primary borehole, the drilling assembly including a drill bit connected to an articulated string portion, the articulated string portion having a plurality of connected sections configured to move laterally with respect to one another; rotating the drill bit and advancing the drilling assembly along the whipstock assembly; and diverting the drill bit and the articulated string portion in a lateral direction by the whipstock ramp to initiate drilling of a secondary borehole from the primary borehole.

Embodiment 12: The method as in any prior embodiment, wherein the plurality of connected sections includes a first section and an adjacent second section connected by a joint configured to permit the first section to be oriented laterally relative to the second section.

Embodiment 13: The method as in any prior embodiment, wherein the joint is formed by a wall of the first section having a shape configured as a male portion, and a wall of the second section having a shape configured as a female portion, the male portion configured to fit into the female portion to connect the first section to the second section.

Embodiment 14: The method as in any prior embodiment, wherein the male portion and the female portion are configured to form a gap therebetween when connected, the gap permitting the male portion to be oriented laterally relative to the female portion.

Embodiment 15: The method as in any prior embodiment, wherein the drill bit is rotated by a fluid displacement motor disposed between the articulated string portion and the drill bit.

Embodiment 16: The method as in any prior embodiment, wherein the drill bit is rotated by rotating the drilling assembly and the articulated string portion from a surface location.

Embodiment 17: The method as in any prior embodiment, wherein the drilling assembly includes a shock absorbing assembly disposed between the articulated string portion and the drill bit.

Embodiment 18: The method as in any prior embodiment, wherein the drilling assembly includes a curved sleeve surrounding at least part of the articulated string portion, the curved sleeve configured to direct the articulated string portion laterally as the articulated string portion is advanced along the whipstock assembly.

Embodiment 19: The method as in any prior embodiment, wherein the non-rotating sleeve includes one or more extendable members configured to be actuated to engage a surface of the borehole to change a direction of the drilling assembly.

Embodiment 20: The method as in any prior embodiment, wherein one or more aspects of the method are performed by controlling an operational parameter of the drill string by a processing device.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An apparatus for drilling a secondary borehole, the apparatus comprising:

a whipstock assembly configured to be deployed in a primary borehole, the whipstock assembly including a whipstock ramp;

a drilling assembly connected to a borehole string, the drilling assembly including a drill bit connected to an articulated string portion having a plurality of connected sections configured to move laterally with respect to one another, wherein the articulated string portion is configured to be diverted by the whipstock ramp in a lateral direction to initiate drilling of a secondary borehole from the primary borehole; and a flexible sleeve surrounding the plurality of connected sections of the articulated string portion, the sleeve having an initial curved shape and configured to be forced from the initial curved shape to conform to a path of the primary borehole during deployment of the drilling assembly along the primary borehole, and form a flexible curved guide in the secondary borehole, wherein a curvature of the flexible curved guide acts in addition to the whipstock ramp to divert the articulated string portion toward the lateral direction.

2. The apparatus of claim 1, wherein the plurality of connected sections includes a first section and an adjacent second section connected by a joint configured to permit the first section to be oriented laterally relative to the second section.

3. The apparatus of claim 2, wherein the joint is formed by a wall of the first section having a shape configured as a male portion, and a wall of the second section having a shape configured as a female portion, the male portion configured to fit into the female portion to connect the first section to the second section.

4. The apparatus of claim 3, wherein the male portion and the female portion are configured to form a gap therebetween, the gap permitting the male portion to be oriented laterally relative to the female portion.

5. The apparatus of claim 1, wherein the drilling assembly and the articulated string portion are configured to be rotated from a surface location.

6. The apparatus of claim 1, further comprising a shock absorbing assembly disposed between the articulated string portion and the drill bit.

7. The apparatus of claim 1, wherein the sleeve is configured to form the flexible curved guide to direct the articulated string portion laterally as the articulated string portion is advanced along the whipstock assembly.

8. The apparatus of claim 7, wherein the curved sleeve includes one or more extendable members configured to be actuated to engage a surface of the borehole to change a direction of the drilling assembly.

9. The apparatus of claim 1, wherein the sleeve is a non-rotating sleeve.

10. A method of drilling a secondary borehole, the method comprising:

deploying a whipstock assembly in a primary borehole, the whipstock assembly including a whipstock ramp;

deploying a borehole string including a drilling assembly in the primary borehole, the drilling assembly including a drill bit connected to an articulated string portion, the articulated string portion having a plurality of connected sections configured to move laterally with respect to one another, the drilling assembly including a flexible sleeve surrounding the plurality of connected sections of the articulated string portion, the sleeve having an initial curved shape and configured to be forced from the initial curved shape to conform to a path of the primary borehole during deployment of the drilling assembly along the primary borehole, and form a flexible curved guide in a secondary borehole;

rotating the drill bit and advancing the drilling assembly along the whipstock assembly; and diverting the drill bit and the articulated string portion in a lateral direction by the whipstock ramp, and diverting the drill bit and the articulated string portion by the flexible curved guide during drilling of the secondary borehole from the primary borehole, wherein a curvature of the flexible curved guide acts in addition to the whipstock ramp.

11. The method of claim 10, wherein the plurality of connected sections includes a first section and an adjacent second section connected by a joint configured to permit the first section to be oriented laterally relative to the second section.

12. The method of claim 11, wherein the joint is formed by a wall of the first section having a shape configured as a male portion, and a wall of the second section having a shape configured as a female portion, the male portion configured to fit into the female portion to connect the first section to the second section.

13. The method of claim 12, wherein the male portion and the female portion are configured to form a gap therebetween when connected, the gap permitting the male portion to be oriented laterally relative to the female portion.

14. The method of claim 10, wherein the drill bit is rotated by rotating the drilling assembly and the articulated string portion from a surface location.

15. The method of claim 14, wherein the drilling assembly includes a shock absorbing assembly disposed between the articulated string portion and the drill bit.

16. The method of claim 10, wherein the sleeve is configured to form the flexible curved guide to direct the articulated string portion laterally as the articulated string portion is advanced along the whipstock assembly.

17. The method of claim 16, wherein the curved sleeve includes a non-rotating sleeve that includes one or more extendable members configured to be actuated to engage a surface of the borehole to change a direction of the drilling assembly.

18. The method of claim 10, wherein one or more aspects of the method are performed by controlling an operational parameter of the drill string by a processing device.

* * * * *